US007845907B2

(12) United States Patent
Pietraszkiewicz et al.

(10) Patent No.: US 7,845,907 B2
(45) Date of Patent: Dec. 7, 2010

(54) BLADE COOLING PASSAGE FOR A TURBINE ENGINE

(75) Inventors: Edward F. Pietraszkiewicz, Southington, CT (US); Atul Kohli, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 698 days.

(21) Appl. No.: 11/781,499

(22) Filed: Jul. 23, 2007

(65) Prior Publication Data

US 2009/0028702 A1 Jan. 29, 2009

(51) Int. Cl.
*F01D 5/18* (2006.01)

(52) U.S. Cl. ..... 416/97 R

(58) Field of Classification Search ..... 416/97 R; 29/889.721, 889.722

See application file for complete search history.

(56) References Cited

U.S. PATENT DOCUMENTS 5,165,852 A * 11/1992 Lee et al. ..... 416/97 R
5,538,394 A * 7/1996 Inomata et al. ..... 416/97 R
6,402,471 B1 * 6/2002 Demers et al. ..... 416/97 R
7,377,746 B2 * 5/2008 Brassfield et al. ..... 416/97 R
7,481,622 B1 * 1/2009 Liang ..... 416/97 R
2003/0075300 A1 * 4/2003 Shah et al. ..... 164/369

FOREIGN PATENT DOCUMENTS

JP 05195704 A * 8/1993

OTHER PUBLICATIONS

JP 5-195704 Machine Translation. http://www4.ipdl.inpit.go.jp/Tokujitu/tjsogodben.ipdl?N0000=115. Search terms: Kind Code: A, No. H05-195704. Accessed Mar. 31, 2010.*

* cited by examiner

*Primary Examiner*—Richard Edgar
(74) *Attorney, Agent, or Firm*—Carlson, Gaskey & Olds, P.C.

(57) ABSTRACT

A blade for a turbine engine includes structure providing spaced apart suction and pressure sides. A cooling passage includes a first passageway near the pressure side and a second passageway in fluid communication with the first passageway. The second passageway is arranged between the first passageway and the suction side. The cooling passage provides a serpentine cooling path that is arranged in a direction transverse from a chord extending between trailing and leading edges of the blade. During use, cooling fluid is supplied to the pressure side through first cooling apertures fluidly connected to the first passageway to the suction side through second cooling apertures fluidly connected to the other passage way. The first passageway is at a higher pressure that then second passageway so that cooling fluid is provided by the cooling passage to the pressure and suction sides in a balanced fashion.

5 Claims, 4 Drawing Sheets

BLADE COOLING PASSAGE FOR A TURBINE ENGINE

BACKGROUND OF THE INVENTION

This application relates to a turbine engine blade. More particularly, the application relates to an orientation of a cooling passage within the blade.

Turbine blades in turbine engines typically include cooling passages that are configured like a serpentine. Airfoil serpentine designs have forward and/or aft flowing serpentines. An inlet of the serpentine typically originates at a root of the turbine blade. The cooling passage extends from the inlet toward the tip before doubling back toward the root. The cooling passage may zigzag back and forth in this fashion in the fore-aft direction, that is, the leading-trailing edge direction.

The serpentine design described above is mainly driven by the core die process in which the die itself has to pull apart to create a ceramic core. The structure of the turbine blade is cast about the ceramic core. Typically, the final terminating up-pass passageway of the serpentine feeds film holes on both the pressure and suction sides of the airfoil. The pressure side film holes supply cooling fluid to fairly high sink pressures, and the suction side film holes supply cooling fluid to relatively low sink pressures. As a result, it is difficult to balance the flow of cooling fluid supplied from the same passageway to both the high and low pressure sides.

What is needed is a blade having a cooling passage that supplies cooling fluid in a more balanced manner to the pressure and suction sides of the blade.

SUMMARY OF THE INVENTION

A blade for a turbine engine includes structure providing spaced apart suction and pressure sides. In one example, the blade is a turbine airfoil. A cooling passage is provided by the structure and extends from an inlet at the root to an end. The cooling passage includes a first passageway near the pressure side and a second passageway in fluid communication with the first passageway. The second passageway is arranged between the first passageway and the suction side. The cooling passage provides a serpentine cooling path that is arranged in a direction transverse from a chord extending between trailing and leading edges of the blade.

In one example, a refractory metal core is used during the casting process to provide the serpentine cooling passage. During use, cooling fluid is supplied to the pressure side of the blade through first cooling apertures fluidly connected to the first passageway. Cooling fluid is supplied to the suction side of the blade through second cooling apertures fluidly connected to the other passageway. The first passageway is at a higher pressure than the second passageway so that cooling fluid is provided by the cooling passage to the pressure and suction sides in a balanced manner.

These and other features of the application can be best understood from the following specification and drawings, the following of which is a brief description.

DETAILED DESCRIPTION OF THE PREFERRED EMBODIMENT

Figure 1:
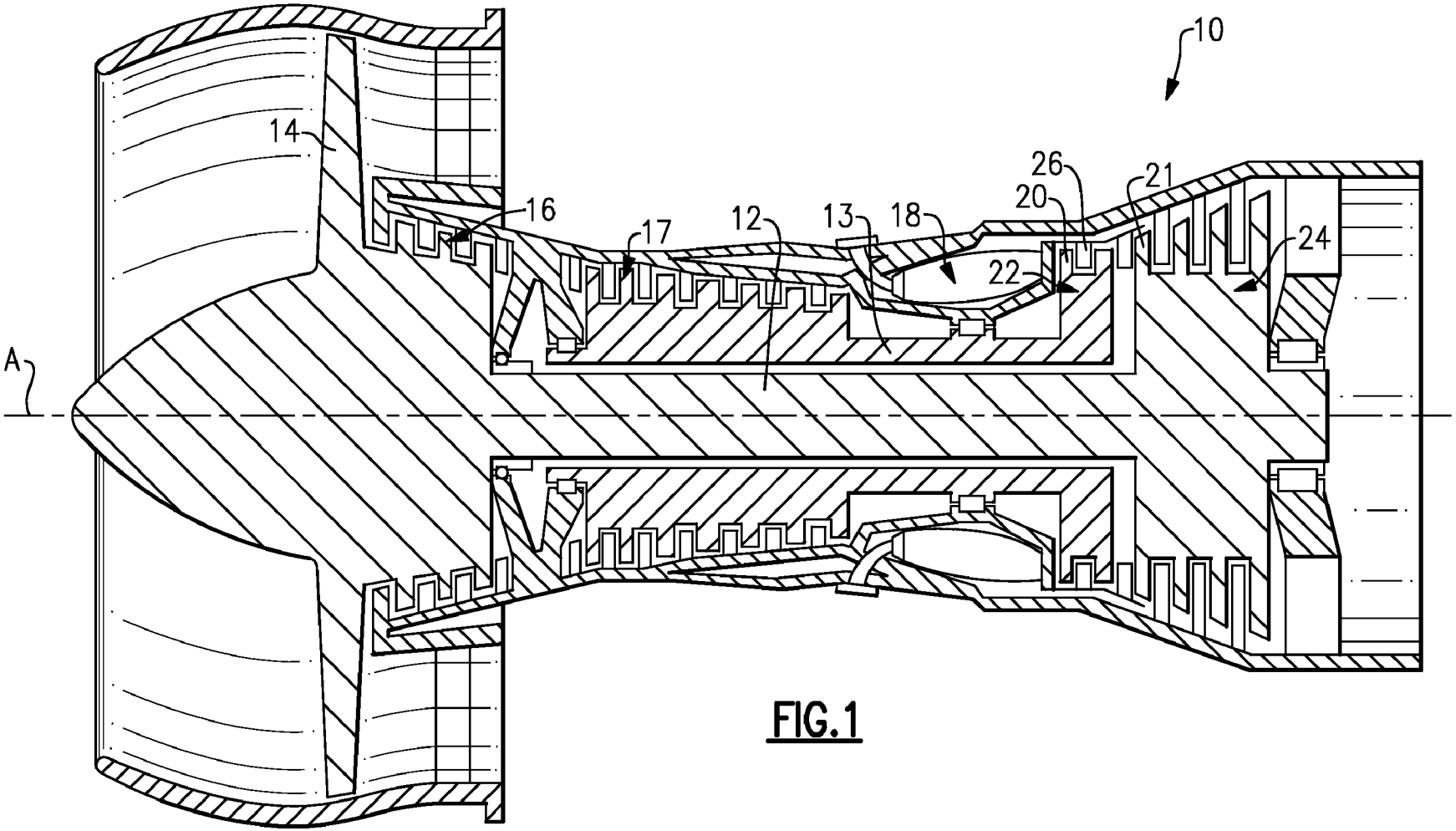
FIG. 1 is cross-sectional schematic view of one type of turbine engine.

One example turbine engine 10 is shown schematically in FIG. 1. As known, a fan section moves air and rotates about an axis A. A compressor section, a combustion section, and a turbine section are also centered on the axis A. FIG. 1 is a highly schematic view, however, it does show the main components of the gas turbine engine. Further, while a particular type of gas turbine engine is illustrated in this figure, it should be understood that the claim scope extends to other types of gas turbine engines.

The engine 10 includes a low spool 12 rotatable about an axis A. The low spool 12 is coupled to a fan 14, a low pressure compressor 16, and a low pressure turbine 24. A high spool 13 is arranged concentrically about the low spool 12. The high spool 13 is coupled to a high pressure compressor 17 and a high pressure turbine 22. A combustor 18 is arranged between the high pressure compressor 17 and the high pressure turbine 22.

The high pressure turbine 22 and low pressure turbine 24 typically each include multiple turbine stages. A hub supports each stage on its respective spool. Multiple turbine blades are supported circumferentially on the hub. High pressure and low pressure turbine blades 20, 21 are shown schematically at the high pressure and low pressure turbine 22, 24. Stator blades 26 are arranged between the different stages.

Figure 2:
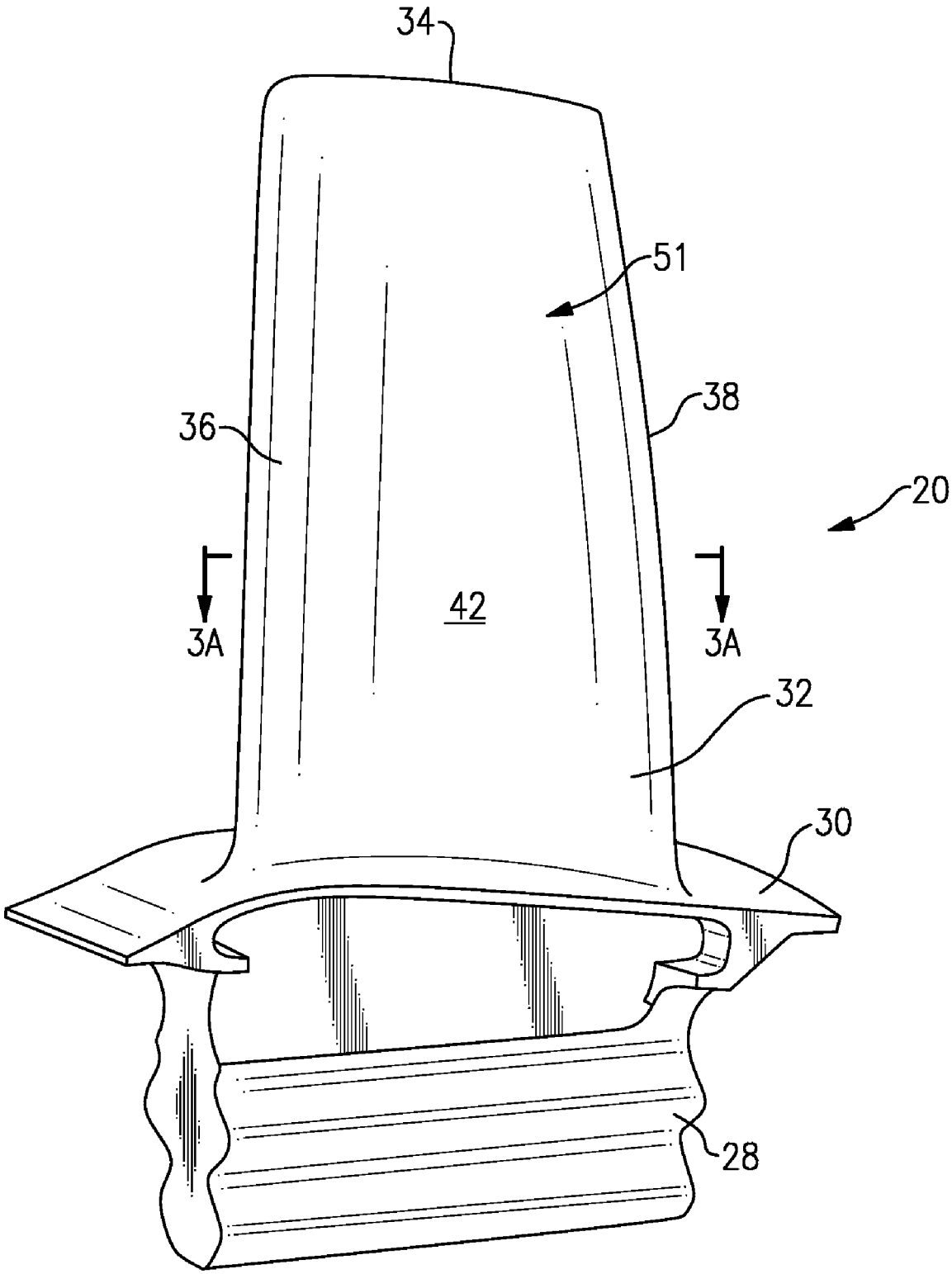
FIG. 2 is a perspective view of a turbine engine blade.
Figure 3A:
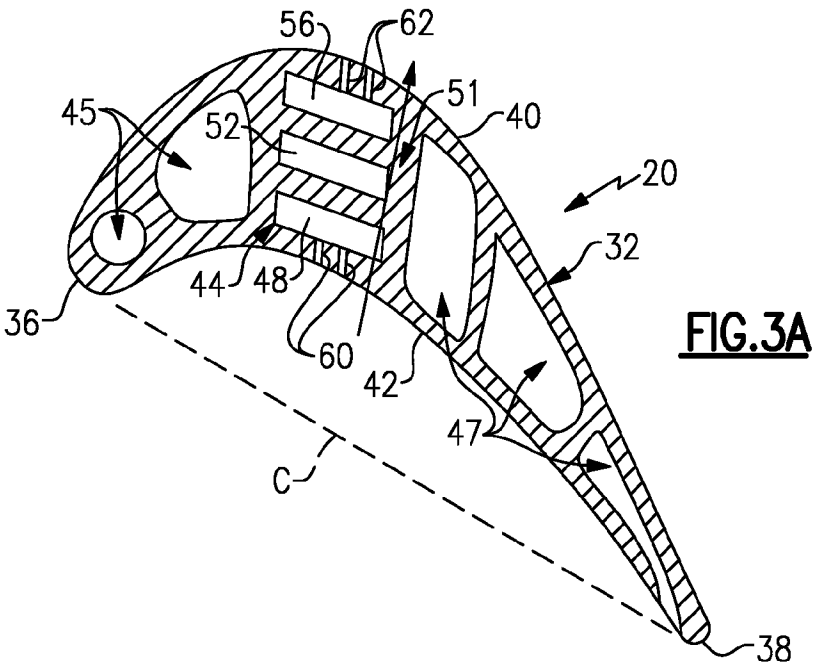
FIG. 3A is a cross-sectional view of the blade shown in FIG. 2 taken along line 3A-3A.

An example high pressure turbine blade 20 is shown in more detail in FIG. 2. It should be understood, however, that the example cooling passage can be applied to other blades, such as compressor blades, stator blades and low pressure turbine blades. The example blade 20 includes a root 28 that is secured to the turbine hub. Typically, a cooling flow, for example from a compressor stage, is supplied at the root 28 to cooling passages within the blade 20 to cool the airfoil. The blade 20 includes a platform 30 supported by the root 28 with a blade portion 32, which provides the airfoil, extending from the platform 30 to a tip 34. The blade 20 includes a leading edge 36 at the inlet side of the blade 20 and a trailing edge 38 at its opposite end. Referring to FIGS. 2 and 3A, the blade 20 includes a suction side 40 provided by a convex surface and a pressure side 42 provided by a concave surface opposite of the suction side 40.

Figure 3B:
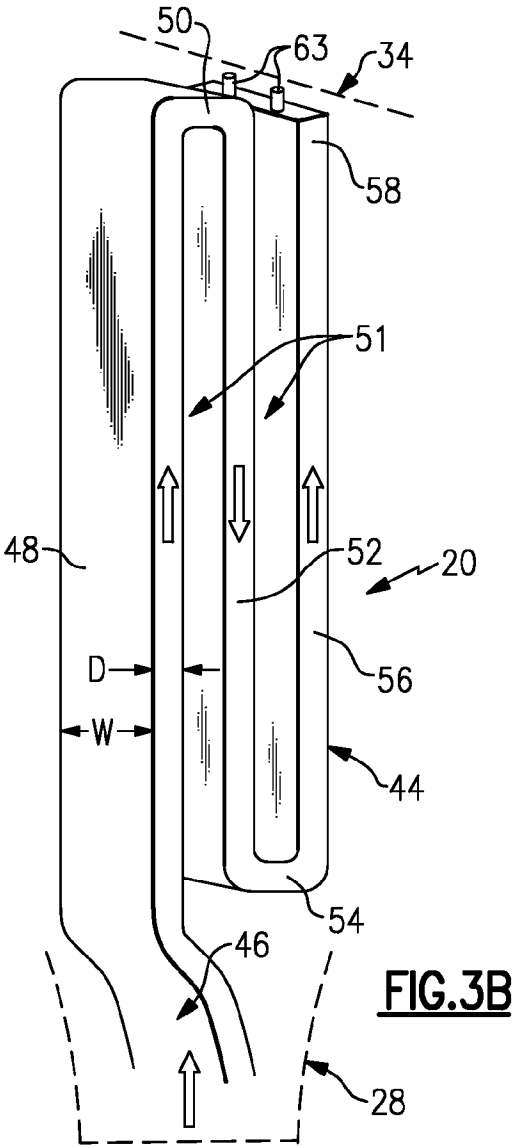
FIG. 3B is a schematic perspective view of a cooling passage shown in FIG. 3A.

A cooling passage 44 configured in a serpentine, as shown in FIG. 3B, is provided by the structure 51 of the blade portion 32. The cooling passage 44 is configured to provide improved cooling to the blade 20 and more balanced air flow provided to the suction and pressure sides 40, 42. Other cooling passages 45, 47 may also be incorporated into the blade 20 and arranged in a conventional fore-aft manner, if desired.

Referring to FIGS. 3A and 3B, the cooling passage 44 includes an inlet 46, which is arranged at the root 28 in one example. The example cooling passage 44 includes a first passageway 48 arranged adjacent to the pressure side 42. The first passageway 48 is generally rectangular in the example shown and includes a width W and a depth D. In one example, the width W is substantially greater than the depth D. In one example, the width W runs in a generally parallel direction to the surface provided by the pressure side 42 to enhance cooling.

The first passageway 48 extends to a second passageway 52 to which is interconnected by a first bend 50. The second passageway 52 extends to a third passageway 56 away from the tip 34 and back toward the root 28 through a second bend 54. In the example shown in FIGS. 3A and 3B, the third passageway 56 terminates in an end 58 arranged near the tip 34. The first, second and third passageways 48, 52, 56 extend in a generally radial direction and are generally parallel to one another in the example shown. Each of the first, second and third passageways 48, 52, 56 are a separate "pass" in the cooling passage 44 through which the cooling fluid changes direction. In the example, the cooling fluid flows in an opposite direction with each passageway.

The pressure within the cooling passage 44 generally decreases as it flows from the inlet 46 to the end 58. Referring to FIG. 3A, first cooling apertures 60 fluidly connect and extend between the first passageway 48 and the pressure side 42 (not shown in FIG. 3B). The third passageway 56 includes second cooling apertures 62 supplying cooling fluid to the suction side 40 (not shown in FIG. 3B). In this manner, the cooling passage 44 is capable of supplying high pressure cooling fluid to the pressure side 42 and lower pressure cooling fluid to the suction side 40 thereby providing a balanced cooling flow to the suction and pressure sides 40, 42. The pressure and suction sides 42, 40 are supplied cooling fluid from separate passageways. In one example shown in FIG. 3B, tip cooling apertures 63 are interconnected to the end 58 for supplying cooling fluid to the tip 34 or it can continue along the tip to the trailing edge of the airfoils or the squealer.

As can be appreciated from the Figures, the first passageway 48 from the inlet 46 is arranged at the pressure side 52 and the downstream passageways extend from the pressure side 42 toward the suction side 40. Said in another way, the passageways 48, 52, 56 extend in a direction that is transverse to a chord C extending between the leading edge 36 and trailing edge 38, which is generally 90 degrees from prior art serpentine cooling passages (e.g. other cooling passages 45, 47).

In one example, refractory metal core technology is employed to provide the cooling passage 44 in the structure 51. During the manufacturing process, the refractory metal core is shaped in the form of a desired cooling passage. The structure 51 is cast about the cooling passage 44. Subsequent to casting, the refractory metal core is removed from the structure 51 using chemicals, for example, according to any suitable core removal processes.

Figure 4:
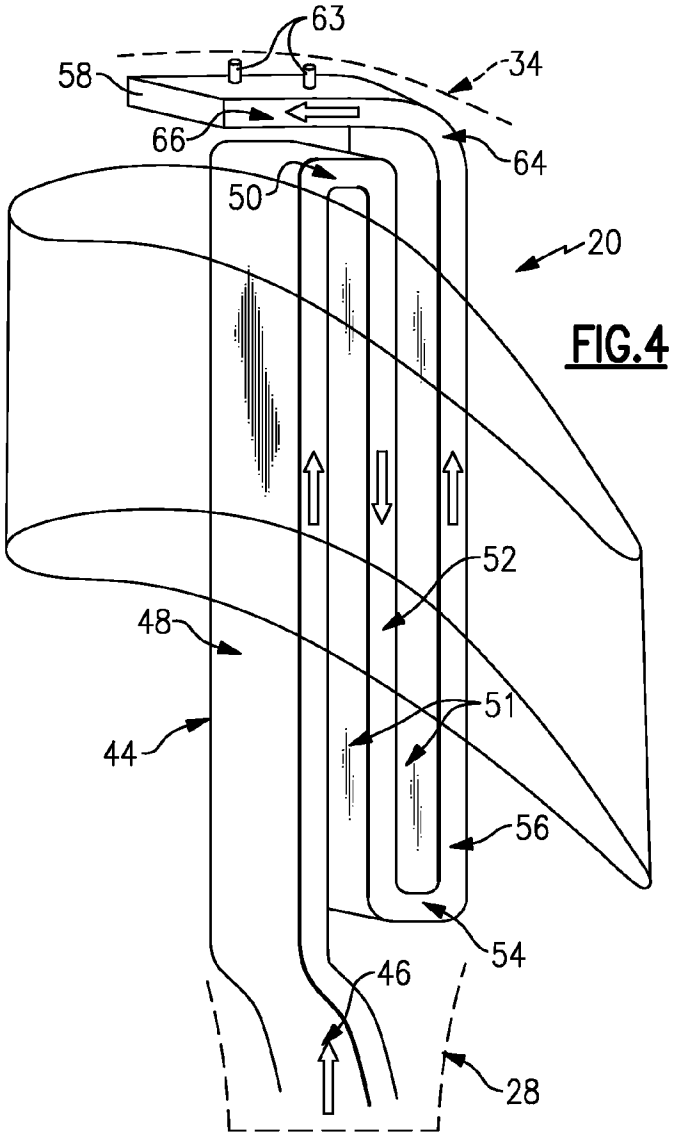
FIG. 4 is a schematic perspective view of another cooling passage configuration.

Another example cooling passage 44 is shown in FIG. 4. The cooling passage 44 depicted is similar to that shown in FIG. 3B. However, the cooling passage 44 also includes a fourth passageway 66 fluidly connected to the third passageway 56 by a third bend 64. The fourth passageway 66 is arranged to extend generally parallel with the tip 34. The tip cooling aperture 63 are in fluid communication with the fourth passageway 66.

Figure 5:
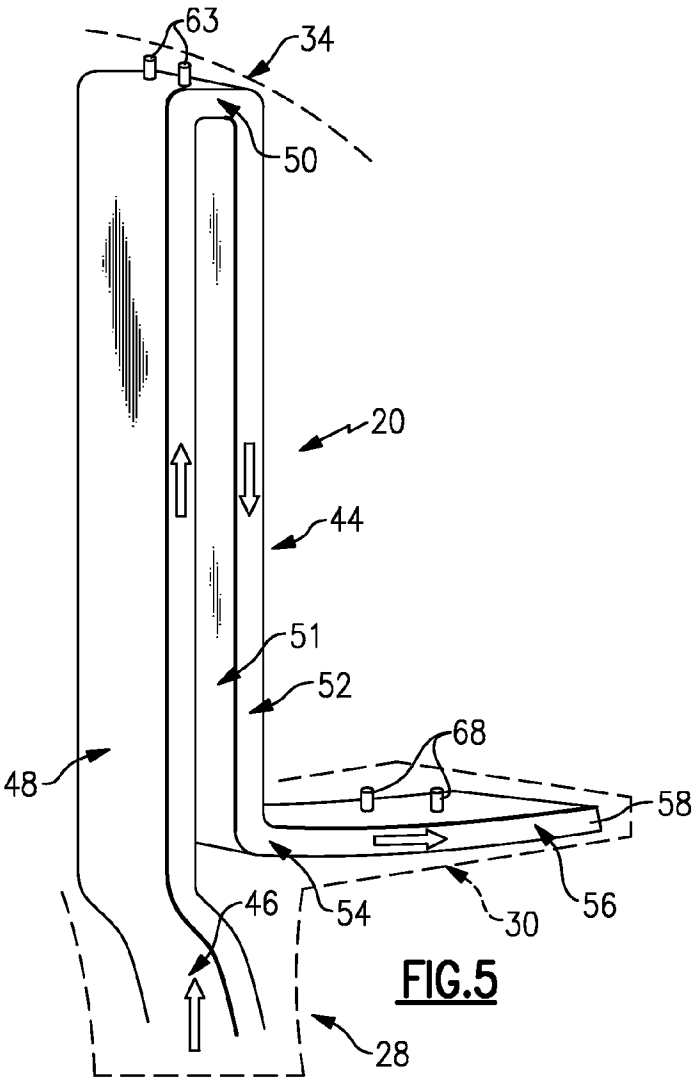
FIG. 5 is a schematic perspective view of yet another cooling passage configuration.

Another example cooling passage 44 is shown FIG. 5. The tip cooling apertures 63 are in fluid communication with the first bend 50. The third passageway 56 is arranged generally 90 degrees from the second passageway 52 and extends to the platform 30. Platform cooling apertures 68 are in fluid communication with the third passageway 56 to provide a cooling flow in that area when desired. Any combination of cooling apertures disclosed above, for example, can be used with the example serpentine cooling passage 44.

Although a preferred embodiment has been disclosed, a worker of ordinary skill in this art would recognize that certain modifications would come within the scope of the claims. For that reason, the following claims should be studied to determine their true scope and content.

What is claimed is:

1. A blade for a turbine engine comprising:

structure providing spaced apart suction and pressure sides; and a cooling passage provided by the structure and including a first passageway near the pressure side and a second passageway arranged between the first passageway and the suction side, wherein the structure includes a root and a tip opposite the root, and the cooling passage includes a first bend arranged near the tip interconnecting the first and second passageways, and another passageway fluidly connected to the second passageway by a second bend arranged radially outward of the first bend near the tip, the other passageway generally perpendicular to the first and second passageways and extends a length generally parallel to the tip from one of the pressure and suction sides and terminates near the other of the pressure and suction sides.

2. The blade according to claim 1, wherein the cooling passage includes an inlet, the cooling passage extending from the inlet to an end, and the end is arranged near the tip.

3. The blade according to claim 1, wherein a third passageway is arranged downstream from the second passageway.

4. The blade according to claim 3, wherein the cooling passage includes a third bend fluidly interconnecting the second and third passageways.

5. The blade according to claim 1, wherein the cooling passage includes a cross-section providing a width and a depth, the width greater than the depth, the width arranged generally parallel to the pressure side.

* * * * *